US005622389A

United States Patent [19]

Courtney

[11] Patent Number: 5,622,389

[45] Date of Patent: Apr. 22, 1997

[54] BUMPER DEVICE AND METHOD

[76] Inventor: Joseph L. Courtney, 225 Canvasback Dr., Bloomingdale, Ga. 31302

[21] Appl. No.: 599,164

[22] Filed: Feb. 9, 1996

[51] Int. Cl.[6] ..... B42D 15/00

[52] U.S. Cl. ..... 283/81; 283/117; 40/591

[58] Field of Search ..... 283/81, 67, 70, 283/56, 117; 40/209, 591, 643

[56] References Cited

U.S. PATENT DOCUMENTS

| | | | |
|---|---|---|---|
| 2,110,768 | 3/1938 | Kellogg . | |
| 2,190,571 | 2/1940 | Salducco . | |
| 2,220,310 | 11/1940 | Wood . | |
| 2,677,910 | 5/1954 | Morgan . | |
| 3,173,219 | 3/1965 | Yarden | 40/591 |
| 3,466,774 | 9/1969 | Borresen . | |
| 3,509,653 | 5/1970 | Hummel | 40/591 |
| 3,826,026 | 7/1974 | Bevan . | |
| 4,707,939 | 11/1987 | Bonner et al. . | |
| 4,736,539 | 4/1988 | Dickinson | 40/643 X |
| 4,756,106 | 7/1988 | Foster . | |
| 4,955,153 | 9/1990 | Albrecht et al. . | |
| 5,077,925 | 1/1992 | Herrera et al. . | |
| 5,099,594 | 3/1992 | Reas et al. | 40/643 X |
| 5,131,177 | 7/1992 | Sy, Jr. . | |
| 5,266,144 | 11/1993 | Gaeto, Jr. . | |

*Primary Examiner*—Willmon Fridie, Jr.
*Attorney, Agent, or Firm*—Nies, Kurz, Bergert & Tamburro

[57] ABSTRACT

A bumper device and method provide a hassle-free system for mounting and replacing bumper stickers. The device includes a clear, trimmable mounting sheet which can receive a bumper sticker and then be attached to the bumper of an automobile. In a preferred embodiment, the device is attached to the bumper using Velcro strips. Once the device is attached to the bumper, it is virtually undetectable to the casual viewer, thus reducing the potential for theft of the sticker and giving the appearance that the sticker is permanently affixed to the bumper.

7 Claims, 1 Drawing Sheet

BUMPER DEVICE AND METHOD

BACKGROUND AND SUMMARY OF THE INVENTION

This invention relates to bumper stickers, and more particularly to a device for aiding in the temporary and convenient placement of a bumper sticker on the bumper of an automobile while allowing the bumper sticker to appear permanently affixed.

Bumper stickers are commonly adhered to vehicle bumpers to display a message contained thereon. When the sticker becomes faded, out of date, or requires removal for any other reason, the owner of the automobile often encounters difficulty in cleanly removing the bumper sticker from the bumper. The bumper may become scratched through using a razor blade to loosen the sticker or the bumper sticker may leave undesirable residue on the bumper. Additionally, the sticker itself usually becomes spoiled upon removal.

Previous efforts to remedy this problem are described in the following U.S. Pat. No. 2,110,768 to Kellogg; U.S. Pat. No. 2,190,571 to Salducco; U.S. Pat. No. 2,220,310 to Wood; U.S. Pat. No. 2,677,910 to Morgan; U.S. Pat. No. 3,466,774 to Borresen; U.S. Pat. No. 3,826,026 to Bevan; U.S. Pat. No. 4,707,939 to Bonner et al.; U.S. Pat. No. 4,736,539 to Dickinson; U.S. Pat. No. 4,756,106 to Foster; U.S. Pat. No. 4,955,153 to Albrecht et al.; U.S. Pat. No. 5,077,925 to Herrera et al.; U.S. Pat. No. 5,099,594 to Reas et al.; U.S. Pat. No. 5,131,177 to Sy, Jr.; and U.S. Pat. No. 5,266,144 to Gaeto, Jr. While all of the above patents describe display holders for certificates, signs, and/or bumper stickers, none teaches the use of an undetectable display holder which is conformable to the size and shape of the sticker and which may be easily installed and removed without damage to the sticker, the holder, or the application surface.

It is thus one object of the present invention to provide a bumper device which allows a bumper sticker to be easily installed and removed.

It is another object of the present invention to provide a bumper device which allows a bumper sticker to be removed without defacing the bumper.

It is yet another object of the present invention to provide a bumper device which is not visible upon application and thereby gives the appearance that the bumper sticker is placed directly on the automobile bumper.

It is a further object of the present invention to provide a bumper device of deformable material so as to be capable of conforming to any size or shape of a given bumper sticker.

By the present invention, there is provided a unique and hassle free device for mounting and replacing bumper stickers. The device includes a mounting sheet of clear, trimmable plastic onto which a bumper sticker may be mounted. The mounting sheet can be provided with means for adhering it to the bumper of an automobile, such as, for example, a strip or strips of Velcro placed on the back of the mounting sheet and on the bumper of the vehicle. Once the sticker is mounted to the device and the device is attached to the bumper, the device becomes virtually undetectable to the casual viewer.

DETAILED DESCRIPTION OF THE PREFERRED EMBODIMENTS

Figure 1:
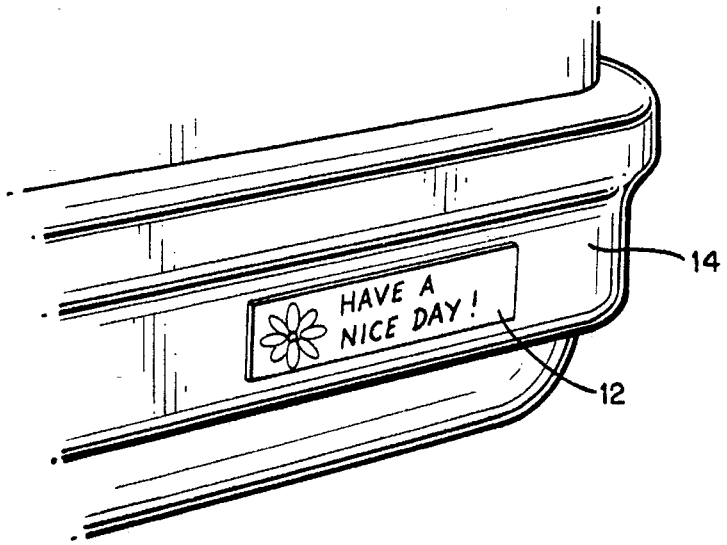
FIG. 1 is a perspective view showing a bumper sticker installed on a vehicle bumper using the device of the present invention.
Figure 2:
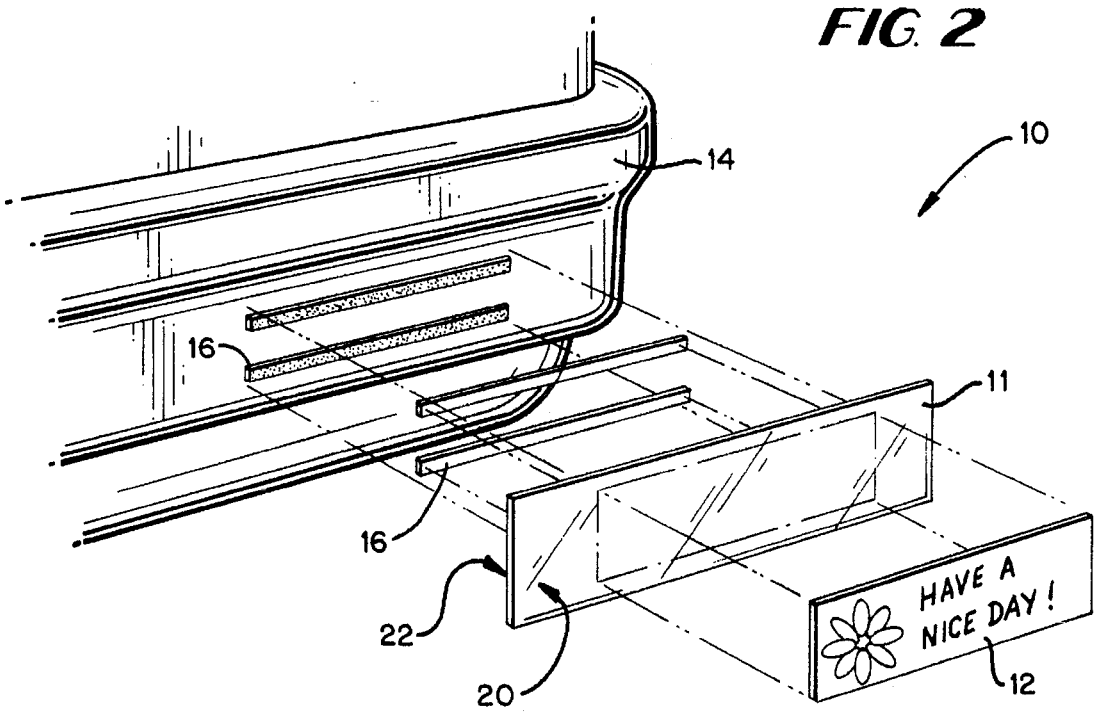
FIG. 2 is a perspective view showing the method of mounting a bumper sticker to a vehicle bumper using the device of the present invention.

In the embodiment of the invention as shown in FIGS. 1 and 2, there is provided a bumper device 10 for simple and convenient placement of a bumper sticker 12 to a mounting surface such as the bumper 14 of an automobile. The bumper device 10 includes a mounting sheet 11 having a front face 20 and a rear face 22. The rear face 22 is provided with Velcro strips 16 or the like to help secure the sheet 11 to the bumper 14. The mounting surface or bumper 14 is also provided with Velcro strips 16 to mate with the strips 16 on the sheet rear face 22. The use of Velcro strips provides a secure connection while allowing simple removal without damage to the bumper's surface. The mounting sheet 11 is preferably formed of a single sheet of clear or transparent plastic material which is trimmable by scissors or the like to conform to the shape of the bumper sticker 12. The sheet 11 should be of a material which is sufficiently durable for mounting on a bumper.

It is within the scope of the present invention to attach the mounting sheet 11 to the bumper 14 by adhesive materials other than Velcro strips, such as, for example, double-sided tape. Bolts or screws may also be employed, although such securing means would not impart some of the advantages described herein with regard to adhesive materials such as Velcro strips. It is also within the scope of the invention to mount the bumper sticker on a surface other than a bumper.

In operation, as shown in FIG. 2, a bumper sticker 12 to be placed on the bumper 14 of an automobile is adhered to the mounting sheet 11 using, for example, the adhesive normally contained on the reverse side of the bumper sticker. The mounting sheet 11 may then be trimmed to match the shape of the bumper sticker 12. There is no limit to the size or shape of the bumper sticker to be employed, other than the bumper itself, as the device 10 will readily accommodate any size or shape. This is a tremendous advantage over prior art display holders which are generally rectangular in shape and cannot aesthetically accommodate stickers of oval, round, square, oversized, or other unconventional shape. Once trimmed, the mounting sheet 11 is mated to the bumper 14 through the use of the Velcro strips 16 located on the bumper 14 and on the rear face 22 of the mounting sheet 11. Upon attachment to the bumper, the sticker 12 will appear to be permanently affixed directly to the bumper 14 while actually being easily removable. The device 10 itself becomes virtually undetectable to the casual observer, as shown in FIG. 1.

The appearance of permanent affixation of the bumper sticker 12 to the bumper 14 is important as this will reduce the potential for theft of the sticker to a greater degree than if the sticker appeared conspicuously inside a holder which permitted easy removal. Additionally, since the sticker 12 is permanently attached to the device 10, it is essentially incapable of attachment to another vehicle without appropriate attachment means such as Velcro strips already on the other vehicle. It would therefore be pointless for one to steal the device with the intent of re-using the sticker. Thus, the present invention, in addition to the advantages already stated, provides a better safeguard against theft than previous display holders.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A bumper device for use in adhering a bumper sticker to the bumper of an automobile or other essentially flat surface, comprising:

a deformable mounting sheet capable of being shaped to match the shape of said bumper sticker, said sheet having a rear face; and means for securing said mounting sheet to said bumper, said securing means including at least one pair of mating Velcro strips, one of said pair of Velcro strips being attached to said rear face of said mounting sheet and the other of said pair of Velcro strips being attached to said bumper.

2. The bumper device of claim 1 wherein said mounting sheet is clear in color.

3. The bumper device of claim 1 wherein said mounting sheet is made of plastic.

4. The bumper device of claim 1 wherein said mounting sheet is trimmable.

5. A method for undetectably mounting a bumper sticker having a given size and given shape to a mounting surface such as the bumper of an automobile, comprising the steps of:

(a) providing a mounting sheet having a front face and a rear face;

(b) mounting said bumper sticker to said front face of said mounting sheet;

(c) trimming said mounting sheet to match said shape and said size of said bumper sticker; and (d) mounting said mounting sheet to said mounting surface.

6. The method of step 5 wherein the step of mounting said mounting sheet to said mounting surface includes the step of providing the mounting sheet rear face and the mounting surface with attachment means.

7. The method of claim 6 wherein said attachment means includes Velcro fasteners mounted to said mounting sheet rear face and said mounting surface.

* * * * *